US009514641B2

(12) United States Patent
Chen

(10) Patent No.: US 9,514,641 B2
(45) Date of Patent: Dec. 6, 2016

(54) SMART REMOTE CONTROL

(71) Applicant: Huawei Technologies Co., Ltd., Shenzhen, Guangdong (CN)

(72) Inventor: Shanxi Chen, Shenzhen (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 420 days.

(21) Appl. No.: 14/090,944

(22) Filed: Nov. 26, 2013

(65) Prior Publication Data

US 2014/0125464 A1 May 8, 2014

Related U.S. Application Data

(63) Continuation of application No. PCT/CN2013/073775, filed on Apr. 7, 2013.

(30) Foreign Application Priority Data

Nov. 2, 2012 (CN) ..... 2012 1 0433839

(51) Int. Cl.
*G08C 19/00* (2006.01)
*G08C 23/04* (2006.01)

(52) U.S. Cl.
CPC ..... *G08C 19/00* (2013.01); *G08C 23/04* (2013.01); *G08C 2201/20* (2013.01)

(58) Field of Classification Search
CPC ..... G08C 19/00; G08C 2201/20; G08C 23/04
See application file for complete search history.

(56) References Cited

U.S. PATENT DOCUMENTS

2003/0193426 A1* 10/2003 Vidal ..... G08C 17/02 341/176
2008/0178224 A1* 7/2008 Laude ..... H04N 5/4403 725/44
2010/0201891 A1 8/2010 Laroia et al.
2011/0289113 A1* 11/2011 Arling ..... G08C 17/02 707/769
2012/0075082 A1 3/2012 Rothkopf et al.
(Continued)

FOREIGN PATENT DOCUMENTS

CN 1677451 A 10/2005
CN 100450056 C 1/2009
(Continued)

*Primary Examiner* — Sisay Yacob
(74) *Attorney, Agent, or Firm* — Leydig, Voit & Mayer, Ltd.

(57) ABSTRACT

A remote control method, a smart terminal, and a smart remote control system. The smart remote control system includes a terminal device and at least one primary device, the terminal device is configured to provide a primary device list for a user; obtain and display a remote control panel of the controlled primary device according to the controlled primary device selected by the user; and sends control information to the controlled primary device according to an operation performed by the user on the remote control panel; and the primary device is configured to perform a corresponding control operation according to the control information. A terminal device is used to provide a remote control function for a user, so that the user may remotely control multiple controlled devices on one terminal device by using the remote control panel.

17 Claims, 7 Drawing Sheets

(56) References Cited

U.S. PATENT DOCUMENTS

2012/0173767 A1* 7/2012 Kim ..... G06F 9/4411
710/11

FOREIGN PATENT DOCUMENTS

| | | | |
|---|---|---|---|
| CN | 101478461 | A | 7/2009 |
| CN | 102546943 | A | 7/2012 |
| CN | 102932695 | A | 2/2013 |
| WO | WO 2007024271 | A1 | 3/2007 |
| WO | WO 2011079189 | A1 | 6/2011 |

* cited by examiner

SMART REMOTE CONTROL

CROSS-REFERENCE TO RELATED APPLICATIONS

This application is a continuation of International Patent Application No. PCT/CN2013/073775, filed on Apr. 7, 2013, which claims priority to Chinese Patent Application No. 201210433839.5, filed on Nov. 2, 2012, both of which are hereby incorporated by reference in their entireties.

TECHNICAL FIELD

The present invention relates to the electronics field, and in particular, to a remote control method for a smart device, a smart terminal, a smart device, and a smart remote control system.

BACKGROUND

With the rapid development of science, technology, and economy, people are living a more and more prosperous life, and household electrical appliances are increasing in type and quantity day by day. A remote control comes out, bringing more convenience and comfort to people in using electrical appliances. However, as more and more everyday household electrical appliances are available in a home, a variety of remote controls come one after another, and people may find that a desk or tea table in a living room is full of remote controls. With more remote controls, we enjoy the convenience in life on one hand; however, on the other hand, we have to stand the chaos caused thereby and a potential threat to a living environment resulted from a need of the remote control for a product, such as a dry cell, which is not environmentally friendly.

In order to solve the problem of "excessive remote controls", in the prior art, a general solution is to use an integrated physical remote control. In this solution, infrared codes of nearly 100 types of household appliances of known brands and models are collected and stored as a library, and the codes are integrated in one physical remote control to make a universal remote control, thereby implementing remote control of multiple household appliances. This solution can solve the problem of "excessive remote controls" to a certain extent; however, it may be applied to control only household appliances of the same type, and the integrated models of controlled appliances are very limited, which is not compatible well with a new household appliance.

Another solution to the problem of "excessive remote controls" in the prior art is to use a cloud remote control solution. A specific solution is that: a picture of a primary device taken by a user is uploaded to a cloud server; the cloud server determines a device type according to the picture, performs analysis to obtain a corresponding infrared coding rule, and then sends the rule to a terminal side (such as an iPad/iPhone); and the terminal may be used as a remote control to control the primary device remotely. The cloud remote control solution can implement the compatibility with household appliances of various models; however, it depends excessively on the cloud server, and cannot control the device without a cloud environment. Meanwhile, the cloud server needs to maintain a large amount of device information, and if the cloud environment does not have the information, the device cannot be controlled. Therefore, the prior art cannot perfectly solve the problem of controlling multiple household appliances in a unified way by using a single remote control.

SUMMARY

In order to solve the technical problem mentioned above, embodiments of the present invention provide a remote control method for a smart device, a smart terminal, and a smart remote control system, to flexibly and efficiently control multiple smart terminals by using a single remote control, thereby improving the integration level, universality, and compatibility of the remote control. The technical solutions are as follows:

In a first aspect, an embodiment of the present invention provides a smart remote control system, including:

a terminal device and at least one primary devices, where the terminal device is configured to provide a primary device list for a user so that the user selects a controlled primary device according to the primary device list; and the terminal device is further configured to obtain and display a remote control panel of the controlled primary device according to the controlled primary device selected by the user, and send control information to the controlled primary device according to an operation performed by the user on the remote control panel; and the primary device is configured to receive the control information sent by the terminal device, and perform a corresponding control operation according to the control information.

In a first possible implementation manner of the first aspect, the terminal device is specifically configured to query and obtain the remote control panel corresponding to the controlled primary device from a remote control panel set pre-configured in the terminal device, and display the remote control panel on a display screen.

In a second possible implementation manner of the first aspect, the terminal device is specifically configured to send a panel request message including identification information of the controlled primary device to a third-party server; receive a response message corresponding to the panel request message and returned by the third-party server, where the response message includes the remote control panel of the controlled primary device; and install the remote control panel and display the remote control panel on a display screen.

In a third possible implementation manner of the first aspect, the terminal device is specifically configured to send a remote control panel request message to the controlled primary device; receive a response message corresponding to the remote control panel request message and returned by the controlled primary device, where the response message includes the remote control panel of the controlled primary device; and install the remote control panel and display the remote control panel on a display screen.

In a second aspect, an embodiment of the present invention further provides a remote control method, including:

providing a primary device list for a user so that the user selects a controlled primary device according to the primary device list;

obtaining and displaying a remote control panel of the controlled primary device; and sending control information to the controlled primary device according to an operation performed by the user on the remote control panel, so that the primary device performs a corresponding control operation according to the control information.

In a first possible implementation manner of the second aspect, the obtaining and displaying a remote control panel of the controlled primary device specifically includes:

querying and obtaining the remote control panel corresponding to the controlled primary device from a remote control panel set pre-configured in the terminal device, and displaying the control panel on a display screen.

In a second possible implementation manner of the second aspect, the obtaining and displaying a remote control panel of the controlled primary device specifically includes:

sending a panel request message including identification information of the controlled primary device to a third-party server;

receiving a response message corresponding to the panel request message and returned by the third-party server, where the response message includes the remote control panel of the controlled primary device; and installing the remote control panel and displaying the remote control panel on a display screen.

In a third possible implementation manner of the second aspect, the obtaining and displaying a remote control panel of the controlled primary device specifically includes:

sending a remote control panel request message to the controlled primary device;

receiving a response message corresponding to the remote control panel request message and returned by the controlled primary device, where the response message includes the remote control panel of the controlled primary device; and installing the remote control panel and displaying the remote control panel on a display screen.

In a third aspect, an embodiment of the present invention further provides a smart terminal, including:

a list providing module, configured to provide a primary device list for a user so that the user selects a controlled primary device according to the primary device list;

a remote control panel obtaining module, configured to obtain and display a remote control panel of the controlled primary device; and a control module, configured to send control information to the controlled primary device according to an operation performed by the user on the remote control panel, so that the primary device performs a corresponding control operation according to the control information.

In a first possible implementation manner of the third aspect, the remote control panel obtaining module specifically includes:

a querying unit, configured to query and obtain the remote control panel corresponding to the controlled primary device from a remote control panel set pre-configured in the terminal device; and a display unit, configured to display the control panel on a display screen.

In a second possible implementation manner of the third aspect, the remote control panel obtaining module specifically includes:

a sending unit, configured to send a panel request message including identification information of the controlled primary device to a third-party server;

a receiving unit, configured to receive a response message corresponding to the panel request message and returned by the third-party server, where the response message includes the remote control panel of the controlled primary device; and a display unit, configured to install the remote control panel and display the remote control panel on a display screen.

In a second possible implementation manner of the third aspect, the remote control panel obtaining module specifically includes:

a sending unit, configured to send a remote control panel request message to the controlled primary device;

a receiving unit, configured to receive a response message corresponding to the remote control panel request message and returned by the controlled primary device, where the response message includes the remote control panel of the controlled primary device; and a display unit, configured to install the remote control panel and display the remote control panel on a display screen.

In a fourth aspect, an embodiment of the present invention further provides a remote control method, including:

receiving a remote control panel request message sent by a terminal device;

sending a response message corresponding to the remote control panel request message to the terminal device, where the response message includes a remote control panel of a controlled device, so that the terminal device displays the remote control panel, and sends control information according to an operation performed by a user on the remote control panel; and receiving the control information, and performing a corresponding control operation according to the control information.

In a fifth aspect, an embodiment of the present invention further provides a smart device, including:

a receiving module, configured to receive a remote control panel request message sent by a terminal device;

a panel sending module, configured to send a response message corresponding to the remote control panel request message to the terminal device, where the response message includes a remote control panel of a controlled device, so that the terminal device displays the remote control panel, and sends control information according to an operation performed by a user on the remote control panel; and an executing module, configured to receive the control information, and perform a corresponding control operation according to the control information.

In the technical solutions provided by the embodiments of the present invention, a smart terminal device is used to provide a remote control function for a user, and a remote control soft panel of a controlled device is dynamically obtained, so that the user may remotely control multiple controlled devices on one terminal device by using the remote control soft panel. Compared with the conventional universal remote control solution, the technical solutions provided by the embodiments of the present invention are compatible with devices of various types, flexible and extendible, and can reduce the costs of remote controls by using a mode of installing a software panel on an existing smart terminal.

BRIEF DESCRIPTION OF DRAWINGS

To illustrate the technical solutions of the present invention more clearly, the following briefly describes the accompanying drawings for describing the embodiments. Apparently, the accompanying drawings in the following description show merely some embodiments of the present invention, and a person of ordinary skill in the art may still derive other drawings from these accompanying drawings without creative efforts.

DESCRIPTION OF EMBODIMENTS

The following clearly describes the technical solutions in the embodiments of the present invention with reference to the accompanying drawings in the embodiments of the present invention. Apparently, the described embodiments are merely a part rather than all of the embodiments of the present invention. All other embodiments obtained by a person of ordinary skill in the art based on the embodiments of the present invention without creative efforts shall fall within the protection scope of the present invention.

With the rapid development of mobile Internet, devices become smarter and smarter. The fact that devices become smart means that a primary device that is used through remote control, such as a television, has more and more powerful interaction capabilities by using interconnected devices. The popularity of smart phones makes a mobile phone more than a communication tool, where more software that is more comprehensive may be installed, thereby making a mobile phone a powerful mobile computing apparatus. By using this technology, embodiments of the present invention provide a technical method for downloading a software remote control panel to a mobile smart terminal (such as a tablet computer or a smart phone), to satisfy the requirement of "more" remote controls. The implementation of the method of the remote control may make a smart terminal a universal remote control for remotely controlling any primary device that supports the downloading of the remote control soft panel.

The technical solution of the present invention may be applied to a variety of remote control scenarios, for example, a system requiring remote control between devices, such as a smart home system and a remote industrial control system. For the convenience of describing the technical solution of the present invention, the following takes remote control for a smart home system as an example for description.

A smart remote control system according to an embodiment of the present invention is described as follows first.

Figure 1:
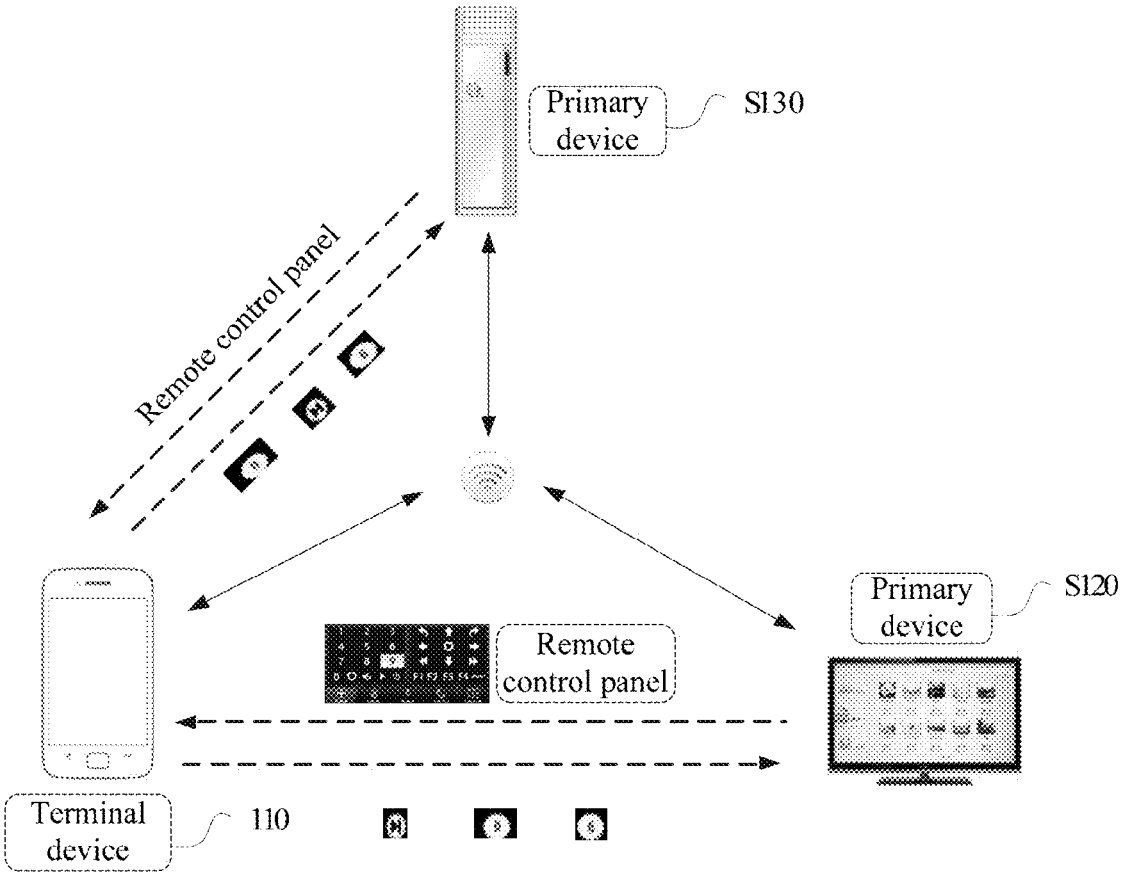
FIG. 1 is a schematic diagram of a smart remote control system according to an embodiment of the present invention.

FIG. 1 is a schematic diagram of a smart remote control system according to an embodiment of the present invention. According to FIG. 1, the smart remote control system includes a terminal device 110 and at least one primary device (as illustrated by 120 and 130 in FIG. 1). It should be noted that the terminal device 110 may be a device, such as a mobile phone and a tablet computer, that has an independent operating system, allows a user to install a program provided by a third-party service provider, and may implement wireless network access by using a wireless network; and the primary device may be a smart electrical device, such as a smart television and a smart air conditioner.

The terminal device 110 is configured to provide a primary device list for a user so that the user selects a controlled primary device according to the primary device list. After the user selects a controlled primary device (assuming that it is 120) from the primary device list, the terminal device 110 is further configured to obtain and display a remote control panel of the primary device 120 according to the controlled primary device 120 selected by the user, receive an operation performed by the user on the remote control panel, and generate and send a corresponding control signal to the controlled primary device 120. After receiving the control information sent by the terminal device 110, the controlled primary device 120 performs a corresponding control operation according to the control information, thereby enabling the user to complete remote control over the controlled primary device.

Specifically, the primary device 120 may communicate with the terminal device 110 through a wireless link. The primary device 120 provides a downloadable remote control soft panel (a bitmap or a vector map). The terminal device 110 is provided with a remote control program to download and display the remote control soft panel, receive a selection and operation performed by the user on the remote control soft panel, and send user operation information to the primary device 120. The primary device 120 identifies the operation information sent by the terminal device 110, converts the operation information into a button-driven signal, and performs a corresponding function.

A remote control initialization process is that: the user selects the controlled primary device on the terminal device and sets an communication (IP or MAC) address Addr and port Port of the controlled primary device; the terminal device sends a device search request by using the communication address; the controlled primary device responds to the request; the terminal device requests for a remote control soft panel; the controlled primary device provides a remote control soft panel and ID thereof to the terminal device; and the terminal device receives the remote control soft panel, and organizes and manages an (ID, Addr, Port, Panel) information pair.

A remote control interaction process is that: the user selects a remote control soft panel of the controlled primary device on the terminal device; the terminal sends a request to the controlled primary device according to (Addr, Port) in panel information; the controlled primary device responds to the request and sets up a communication link; and then the terminal device may control the controlled primary device remotely.

In an implementation manner, the remote control soft panel of the primary device may be provided to multiple terminal devices through multiple communication ports, and the primary device may communicate with the multiple terminal devices through the multiple communication ports, thereby implementing a function of controlling a primary device remotely and simultaneously by multiple terminal devices.

Figure 2:
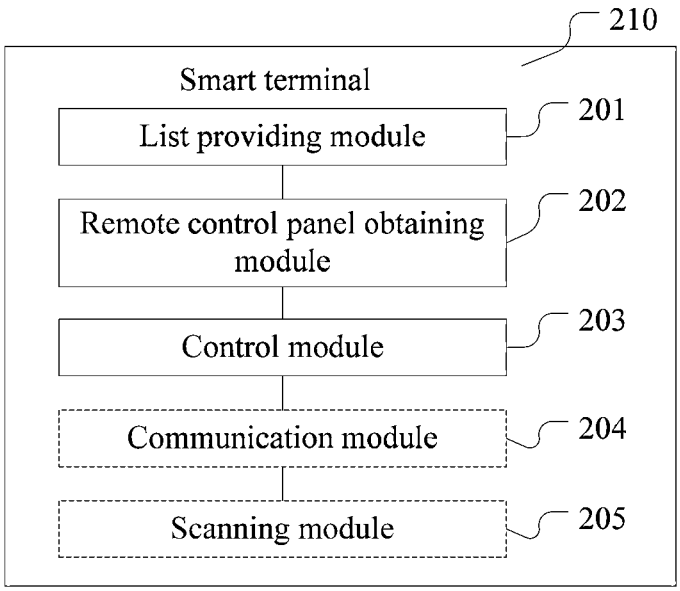
FIG. 2 is a schematic diagram of a smart terminal according to an embodiment of the present invention.

Further, in the smart remote control system according to the embodiment of the present invention, the terminal device 110 having the universal remote control function may specifically be a smart terminal 210, where a schematic diagram thereof is shown in FIG. 2.

The smart terminal 210 includes a list providing module 201, a remote control panel obtaining module 202, and a control module 203, where the list providing module 201 is configured to provide a primary device list for a user so that the user selects a controlled primary device according to the primary device list;

the remote control panel obtaining module 202 is configured to obtain and display a remote control panel of the controlled primary device; and the control module 203 is configured to send control information to the controlled primary device according to an operation performed by the user on the remote control panel, so that the primary device performs a corresponding control operation according to the control information.

Specifically, the remote control panel obtaining module 202 may obtain the remote control panel of the primary device in multiple manners.

In an implementation manner, the remote control panel obtaining module 202 specifically includes:

a querying unit, configured to query and obtain the remote control panel corresponding to the controlled primary device from a remote control panel set pre-configured in the terminal device; and a display unit, configured to display the control panel on a display screen.

In another implementation manner, the remote control panel obtaining module 202 specifically includes:

a sending unit, configured to send a panel request message including identification information of the controlled primary device to a third-party server;

a receiving unit, configured to receive a response message corresponding to the panel request message and returned by the third-party server, where the response message includes the remote control panel of the controlled primary device; and a display unit, configured to install the remote control panel and display the remote control panel on a display screen.

In another implementation manner, the remote control panel obtaining module 202 specifically includes:

a sending unit, configured to send a remote control panel request message to the controlled primary device;

a receiving unit, configured to receive a response message corresponding to the remote control panel request message and returned by the controlled primary device, where the response message includes the remote control panel of the controlled primary device; and a display unit, configured to install the remote control panel and display the remote control panel on a display screen.

In an embodiment, the smart terminal 210 further includes a communication module 204, configured to send, before the control module sends the control information to the controlled primary device, a control request message to the controlled primary device; receive a response message corresponding to the control request message and returned by the controlled primary device; and set up a communication link with the controlled primary device.

Further, the smart terminal 210 further includes a scanning module 205, configured to search, before the list providing module provides the primary device list for the user, a current area for a primary device, to update the primary device list.

Figure 3:
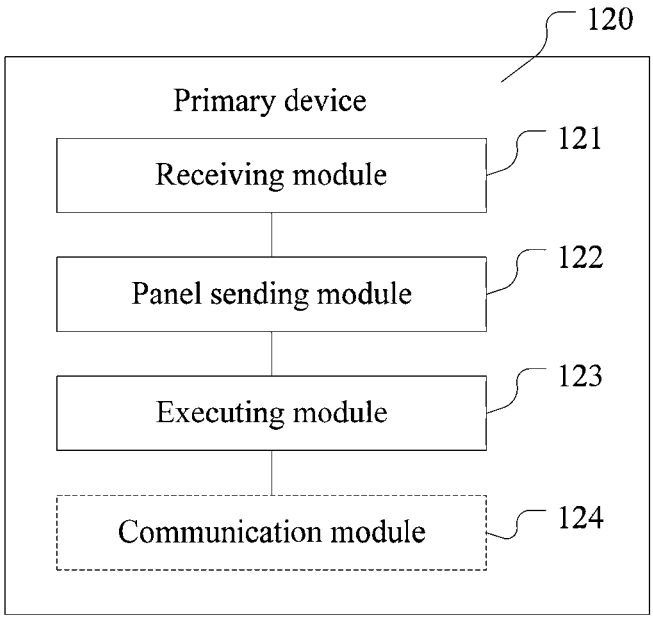
FIG. 3 is a schematic diagram of a primary device according to an embodiment of the present invention.

Correspondingly, in the smart remote control system according to the embodiment of the present invention, a schematic diagram of the primary device 120 (which may also be referred to as a smart device) is shown in FIG. 3.

The primary device includes a receiving module 121, a panel sending module 122, and an executing module 123, where the receiving module 121 is configured to receive a remote control panel request message sent by a terminal device;

the panel sending module 122 is configured to send a response message corresponding to the remote control panel request message to the terminal device, where the response message includes a remote control panel of a controlled device, so that the terminal device displays the remote control panel, and sends control information according to an operation performed by a user on the remote control panel; and the executing module 123 is configured to receive the control information, and perform a corresponding control operation according to the control information.

In an embodiment, the primary device further includes a communication module 124, configured to receive, before the executing module receives the control information, a control request message sent by the terminal device, return a response message corresponding to the control request message to the terminal device, and set up a communication link with a controlled primary device.

In another implementation manner, a gateway may be set for a primary device required to be controlled remotely. In this way, the terminal device may communicate with the controlled primary device by using the gateway, thereby implementing the function of controlling the primary device remotely.

The following describes a software implementation manner of the technical solution of the present invention.

Figure 4:
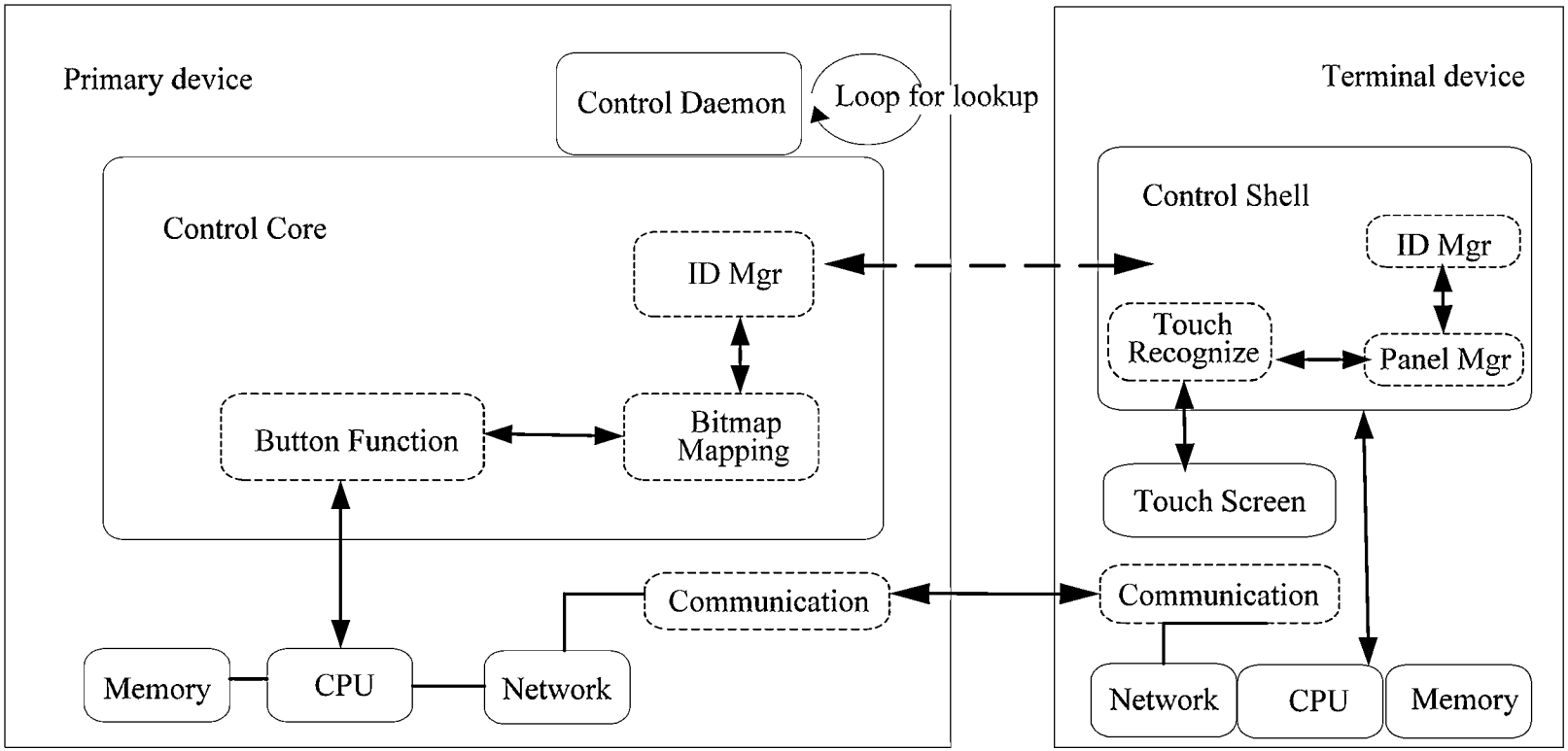
FIG. 4 is a schematic diagram of a software architecture of a smart remote control system according to an embodiment of the present invention.

As shown in FIG. 4, a core of software composition of the smart remote control system according to the embodiment of the present invention has three parts:

(1) a remote control monitoring and listening process CD-Control Daemon (hereinafter referred to as CD) on a primary device, used to listen for an access request for a remote control function from a terminal device;

(2) a remote control core CC-Control Core (hereinafter referred to as CC) on the primary device, which is responsible for managing a remote control soft panel and receiving button identification of a smart terminal serving as a remote control, where the CC specifically includes a remote control panel ID managing module ID Mgr, a bitmap converting module Bitmap Mapping, and a button function mapping module Button Function; the ID Mgr is mainly responsible for assigning and managing an ID number of a remote control soft panel for the primary device; the Bitmap Mapping mainly maps virtual buttons on the remote control soft panel into real physical button information; and the Button Function invokes a hardware driver related to a function corresponding to the physical button according to the mapped physical button information, which is then performed by using a CPU to complete a corresponding action; and (3) a remote control shell CS-Control Shell (hereinafter referred to as CS) on the terminal device, which displays the remote control soft panel, sends button information to the smart device according to a button operation performed by the user, and manages a remote control soft panel of multiple devices, where the CS may specifically include a touch recognizing module Touch Recognize, a panel managing module Panel Mgr, and a remote control panel ID managing module ID Mgr; the touch recognizing module specifically identifies an operation performed by the user on the remote control panel and converts the operation into a touch control signal; the panel managing module is mainly configured to install the remote control soft panel and manage all remote control soft panels on the terminal device; and the remote control panel ID managing module is mainly responsible for managing an ID number of a remote control soft panel.

It may be understood that, the software implementation of the remote control system according to the present invention depends on hardware entities such a CPU, a memory (Memory in FIG. 4), a network interface (Network in FIG. 4), a touch screen (Touch Screen in FIG. 4), and communication modules (Communication in FIG. 4) of the primary device and the terminal device. An operating principle of the hardware belongs to the prior art and will not be described herein.

The following describes two core implementation processes based on the software architecture, that is, a remote control initialization process and a remote control operation process. The former provides availability of remote control, and the latter provides selection of remote control. A primary device (a target end of a remote control operation) and a terminal device (a source end of the remote control operation) implemented based on the two processes may enable the terminal device to be a universal remote control that may control multiple primary devices remotely.

The remote control initialization process of the terminal device as a remote control is as follows:

Step 1: A CD of a primary device performs listening by using (Addr, Port).

Step 2: A user configures the primary device (Addr, Port); a terminal CS requests to use the communication address as a communication request, where Addr represents a communication address (for example, an IP address or a MAC address) of the primary device, and Port represents a port number of the primary device.

Step 3: The CD guides the CS to set up communication with a CC.

Step 4: The CC sends a ccID to the CS.

Step 5: The CS receives the ccID, and if the ID does not exist, performs step 6.

Step 6: The CS requests the CC to provide a remote control soft panel of a remote control.

Step 7: The CC downloads the remote control soft panel of a remote control for the CS, where information included in the remote control soft panel is (Panel ID, name, Panel Data), and Panel ID, Name, and Panel Data respectively identify an identifier number, a name, and panel data of the remote control panel.

Step 8: The CS stores and manages the information of the remote control soft panel, where the content includes (Panel ID, Name, Panel Data, Addr, Port).

Figure 5:
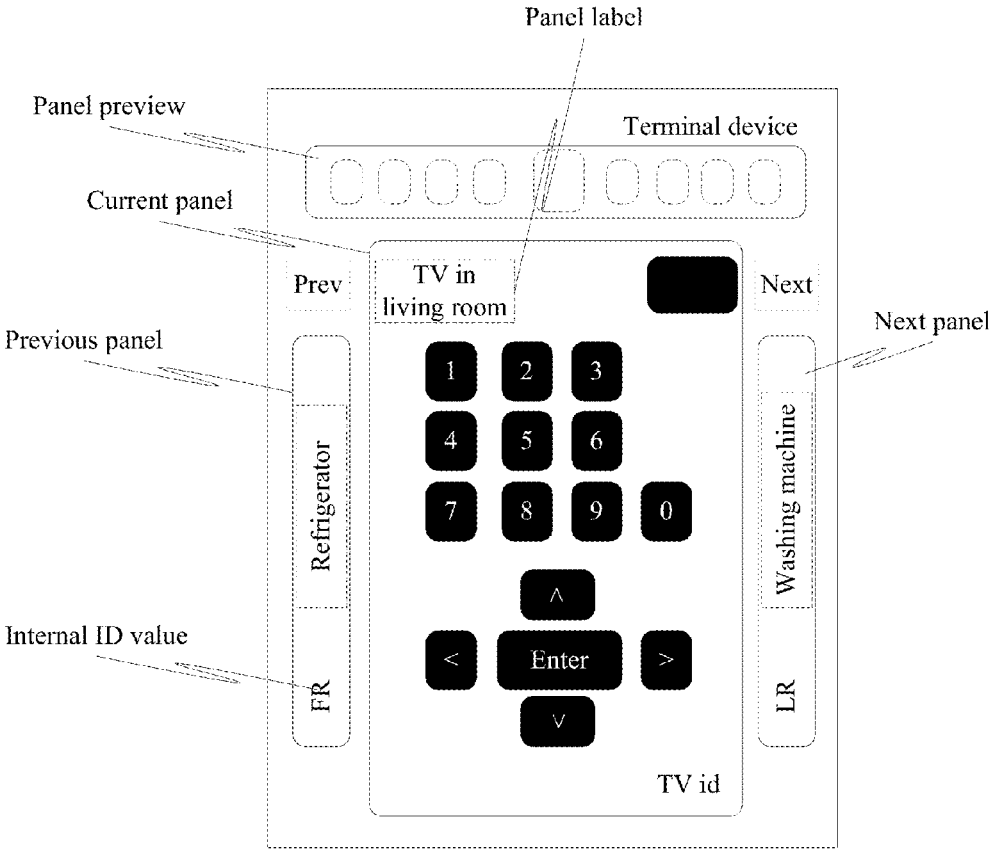
FIG. 5 is an exemplified diagram of an interface of a remote control soft panel according to an embodiment of the present invention.

FIG. 5 is an example of an interface of a remote control soft panel displayed on a terminal device according to an embodiment of the present invention. According to FIG. 5, the terminal device provides alternative options of remote control soft panels for multiple primary devices, and a user may select one by performing left or right sliding or by directly clicking in a preview mode. No matter how the display and selection of the remote control soft panels are organized, a "current" primary device that is controlled remotely will finally be determined according to a user operation, that is, a primary device with which the terminal is going to communicate is determined.

When the user determines a "current" primary device as a remote control object, subsequent implementation steps are as follows:

Step 1: Determine whether the terminal device has a communication connection with the primary device; if yes, perform step 3; otherwise, perform step 2.

Step 2: The terminal device sends a communication request to the primary device by using (Addr, Port) in management information related to the remote control soft panel; if the primary device responds, perform step 3; otherwise, display the remote control soft panel in a different way (for example, in gray), indicating that the remote control soft panel is unavailable, and the user may continue to select another remote control soft panel, and return to step 1.

Step 3: After receiving an operation performed by the user on a screen, the terminal device collects, area information of the screen, and sends button information to a controlled primary device according to a corresponding relationship between the area information and the remote control soft panel.

Step 4: The primary device receives the button information of the user, determines an action performed by the user on the device, and invokes a relevant function to drive the device to respond.

Figure 6:
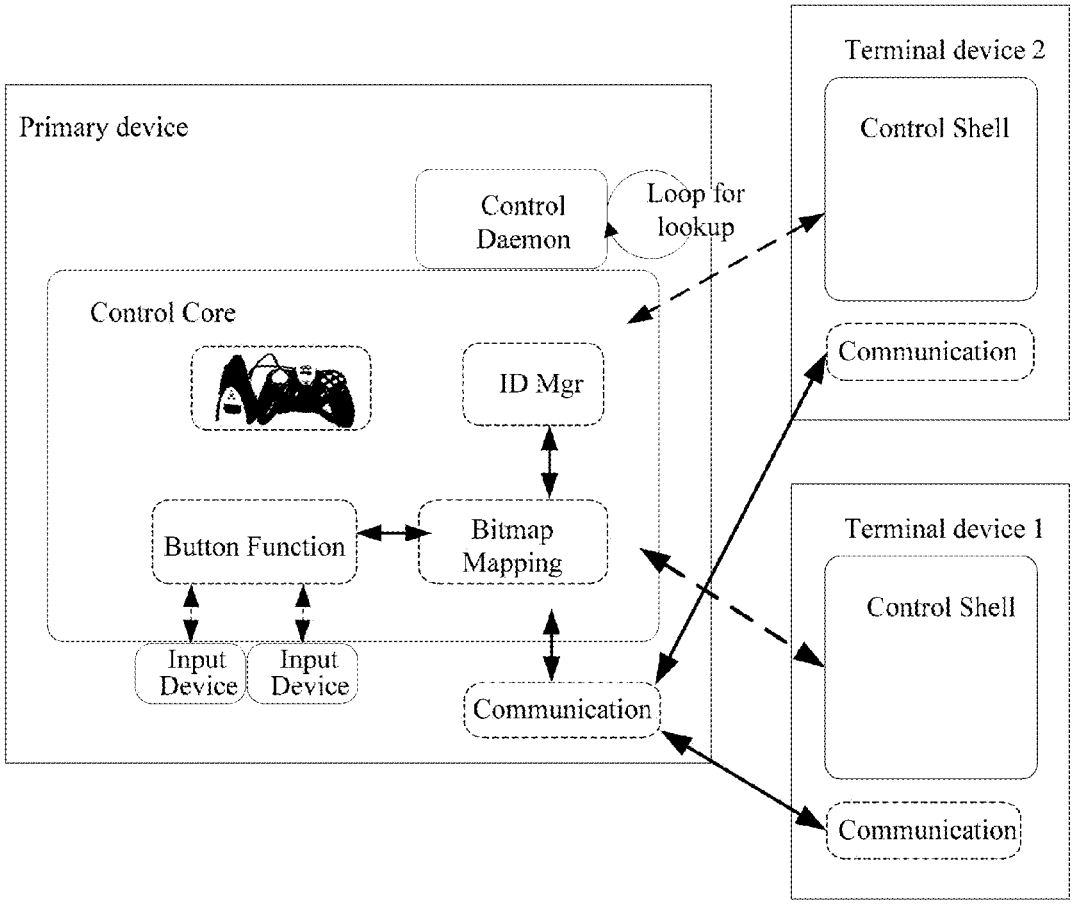
FIG. 6 is a schematic diagram of a software architecture of another smart remote control system according to an embodiment of the present invention.

In another specific application example, a primary device (such as a game machine) may be controlled remotely by using multiple terminal devices, where modules for implementing functions thereof are shown in FIG. 6. In this case, when a CS of a terminal device is connected to a CC of a primary device, a specific identifier is used to differentiate multiple terminal devices. That is, when the CS of the terminal device initiates an access request to the primary device, the terminal device identifier and a control shell ID number of the primary device are included in the request message. In this way, button information on different terminal devices is identified and converted into InputDevice in the CC, and then a relevant interface is invoked according to the terminal device identifier InputDevice, to drive a corresponding function.

It should be noted that the apparatus or system embodiment described above is merely illustrative, where the units described as separate components may be or may be not physically separate, and the components displayed as units may be or may be not physical units, and may be located in one place or be distributed on multiple network units. Part or all of modules may be selected depending on the actual requirement to achieve the objective of the solution in this embodiment. Moreover, the software implementation manner described above is merely one specific implementation form, and it may be understood that the apparatus or system embodiment described above may be completely implemented by means of hardware, and a person of ordinary skill in the art may understand and implement the same without creative efforts.

In the smart remote control system according to the embodiment of the present invention, a smart terminal device is used to provide a remote control function for a user, and a remote control soft panel of a controlled device is dynamically obtained, so that the user may remotely control multiple controlled devices on one terminal device by using the remote control soft panel. Compared with the conventional universal remote control solution, the technical solution provided by the embodiment of the present invention are compatible with devices of various types, flexible and extendible, and can reduce the costs of remote controls by using a mode of installing a software panel on an existing smart terminal.

Based on the apparatus or system embodiment, the following describes a remote control method provided by the present invention with reference to specific application examples.

Figure 7:
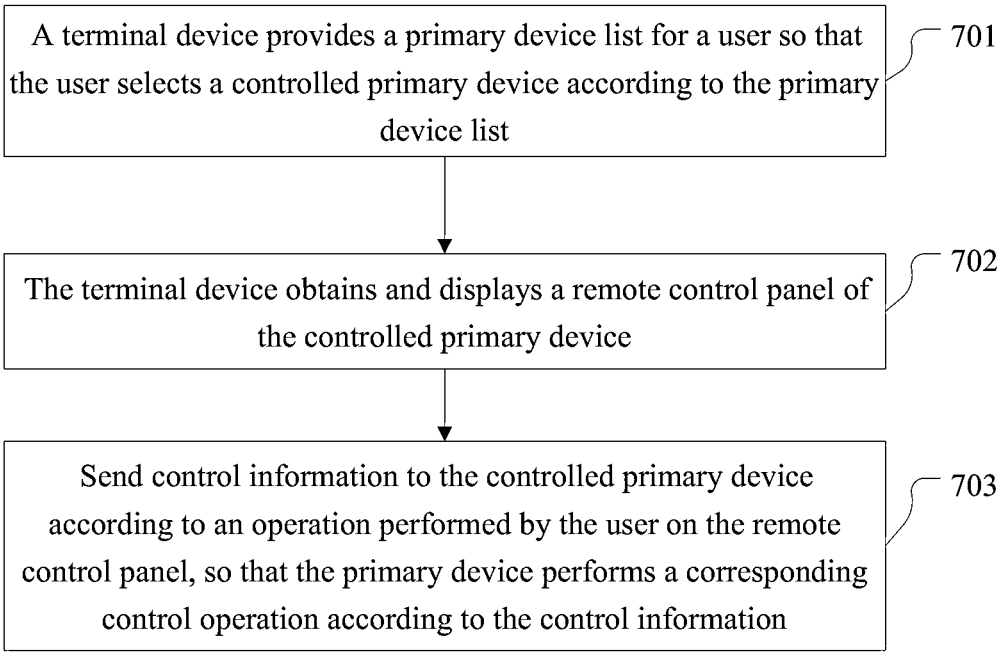
FIG. 7 is a flowchart of a remote control method according to an embodiment of the present invention.

As shown in FIG. 7, a remote control method according to an embodiment of the present invention includes the following steps:

S701. A terminal device provides a primary device list for a user so that the user selects a controlled primary device according to the primary device list.

Specifically, the terminal device may present, in various presentation manners such as list or graphic preview, information about a primary device that may be controlled remotely by a user. In addition, the terminal device may search a current area for a primary device in real time or periodically, and update the primary device list.

S702. The terminal device obtains and displays a remote control panel of the controlled primary device.

Specifically, the terminal device may obtain the remote control panel of the controlled primary device in multiple ways. In an implementation manner, the user or a device manufacturer may pre-configure a remote control panel set including multiple primary devices in the terminal device, so that the terminal device may obtain the remote control panel corresponding to the controlled primary device by querying, and display the remote control panel on a display screen thereof for a user to operate.

In another implementation manner, the terminal device may download the remote control panel of the controlled primary device from a third-party server. Specifically, the terminal device sends a panel request message including identification information of the controlled primary device to a third-party server; after receiving the panel request message, the third-party server sends a response message corresponding thereto to the terminal device, where the response message includes remote control panel information of the controlled primary device; after receiving the response message returned by the third-party server, the terminal device installs the remote control panel according to the remote control panel information in the response message, and displays the remote control panel on the display screen.

In another implementation manner, the terminal device may set up a communication link with the controlled primary device, and dynamically obtain the remote control panel of the controlled primary device. Specifically, after the communication link between the terminal device and the controlled primary device is set up, the terminal device sends a remote control panel request message to the controlled primary device, and receives a response message corresponding to the remote control panel request message and returned by the controlled primary device, where the response message includes the remote control panel of the controlled primary device; and the terminal device installs the remote control panel according to data in the response message, and displays the remote control panel on the display screen.

S703. Send control information to the controlled primary device according to an operation performed by the user on the remote control panel, so that the primary device performs a corresponding control operation according to the control information.

Specifically, before sending the control information to the controlled primary device, the terminal device may set up a control link with the controlled primary device by using a message response mechanism. For example, the terminal device sends a control request message to the controlled primary device, and then receives a response message corresponding to the control request message and returned by the controlled primary device, and sets up a control link with the controlled primary device.

Figure 8:
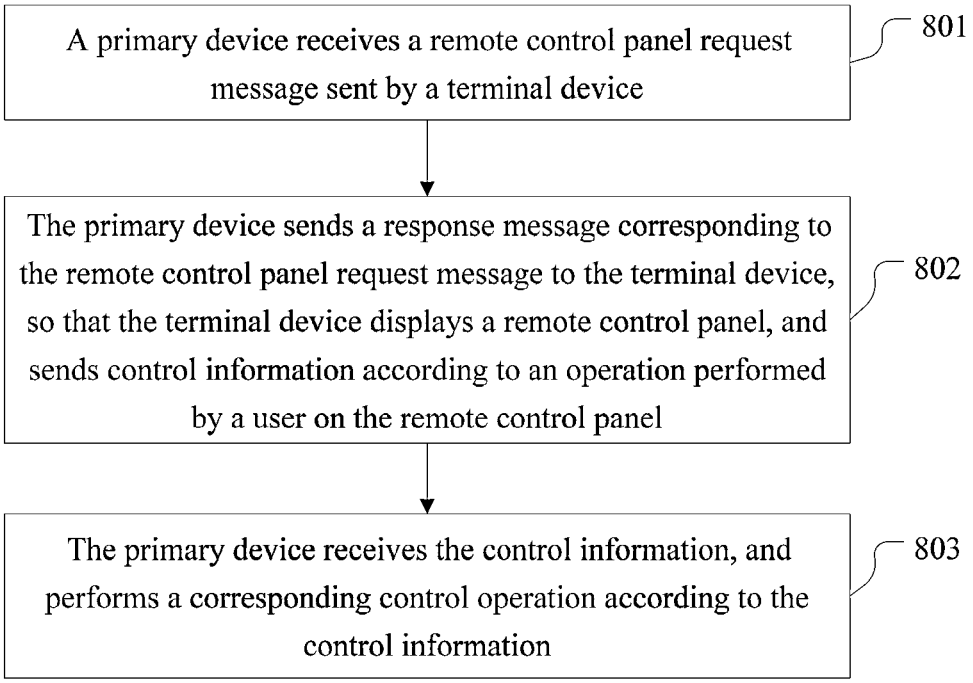
FIG. 8 is a flowchart of another remote control method according to an embodiment of the present invention.

FIG. 8 is a flowchart of another remote control method according to an embodiment of the present invention. As shown in FIG. 8, the remote control method includes the following steps.

S801. A primary device receives a remote control panel request message sent by a terminal device.

S802. The primary device sends a response message corresponding to the remote control panel request message to the terminal device, where the response message includes a remote control panel of a controlled device, so that the terminal device displays the remote control panel, and sends control information according to an operation performed by a user on the remote control panel.

S803. The primary device receives the control information, and performs a corresponding control operation according to the control information.

The method embodiments basically correspond to the apparatus or system embodiments, so reference may be made to the description in the apparatus or system embodiments for relevant parts.

In the remote control methods according to the embodiments of the present invention, a smart terminal device is used to provide a remote control function for a user, and a remote control soft panel of a controlled device is dynamically obtained, so that the user may remotely control multiple controlled devices on one terminal device by using the remote control soft panel. Compared with the conventional universal remote control solution, the technical solutions provided by the embodiments of the present invention are compatible with devices of various types, flexible and extendible, and can reduce the costs of remote controls by using a mode of installing a software panel on an existing smart terminal.

Figure 9:
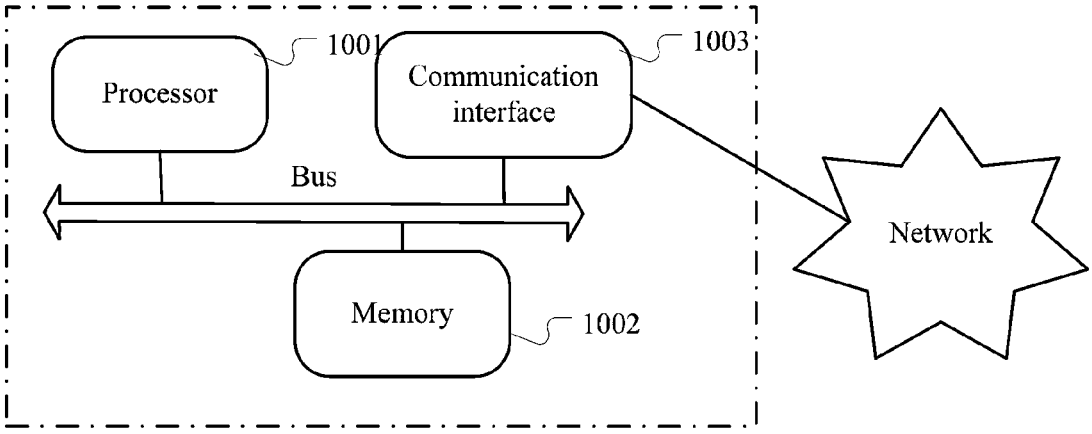
FIG. 9 is a schematic structural diagram of a remote control device according to an embodiment of the present invention.

FIG. 9 is a schematic structural diagram of a remote control device according to another embodiment of the present invention. As shown in FIG. 9, the remote control device according to the embodiment includes at least one processor 1001, a memory 1002, a communication interface 1003, and a bus. The processor 1001, the memory 1002, and the communication interface 1003 are connected and communicate with each other by using the bus. The bus may be an Industry Standard Architecture (Industry Standard Architecture, ISA for short) bus, a Peripheral Component Interconnect (Peripheral Component, PCI for short) bus, an Extended Industry Standard Architecture (Extended Industry Standard Architecture, EISA for short) bus, and the like. The bus may be classified into an address bus, a data bus, a control bus, and the like. For the convenience of denotation, the bus is represented by using one thick line in FIG. 9; however, it does not indicate that there is only one bus or only one type of buses.

The memory 1002 is configured to store executable program codes, where the program codes include computer operation instructions. The memory 1002 may include a high-speed RAM memory, and may also include a non-volatile memory (non-volatile memory), such as at least one disk memory.

In an embodiment, the processor 1001 runs a program corresponding to the executable program codes by reading the executable program codes stored in the memory 1002, so as to:

provide a primary device list for a user so that the user selects a controlled primary device according to the primary device list;

obtain and display a remote control panel of the controlled primary device; and send control information to the controlled primary device according to an operation performed by the user on the remote control panel, so that the primary device performs a corresponding control operation according to the control information.

In another embodiment, the processor 1001 runs a program corresponding to the executable program codes by reading the executable program codes stored in the memory 1002, so as to:

receive a remote control panel request message sent by a terminal device;

send a response message corresponding to the remote control panel request message to the terminal device, where the response message includes a remote control panel of a controlled device, so that the terminal device displays the remote control panel, and sends control information according to an operation performed by a user on the remote control panel; and receive the control information, and perform a corresponding control operation according to the control information.

The processor 1001 may be a central processing unit (Central Processing Unit, CPU for short), or an application-specific integrated circuit (Application-Specific Integrated Circuit, ASIC for short), or be configured into one or more integrated circuits for implementing the embodiment the present invention.

It should be noted that the processor 1001, besides having the functions described above, may further be configured to implement other processes in the method embodiments, and will not be described again herein.

The communication interface 1003 is mainly configured to implement communication between the device in the embodiment and another device or apparatus in this embodiment.

In the embodiments provided in the present invention, it should be understood that the disclosed system, apparatus and method may be implemented in other manners without departing from the spirit and scope of this application. The current embodiments are merely exemplary examples, and should not be regarded as a limitation, and the detailed content should not limit the objective of this application. For example, the division of units or subunits is merely logic function division and can be other divisions in actual implementation. For example, multiple units or multiple subunits are combined together. In addition, multiple units or components may be combined or integrated in another system or some features may be ignored or not executed.

In addition, the schematic diagrams illustrating the system, apparatus, method and different embodiments may be combined or integrated with other systems, modules, technologies or methods without departing from the scope of the present invention. In addition, the displayed or discussed mutual couplings or direct couplings or communication connections may be implemented through some interfaces. The indirect couplings or communication connections between the apparatuses or units may be implemented in electronic, mechanical or other forms.

The foregoing descriptions are merely specific embodiments of the present invention. It should be noted by a person of ordinary skill in the art that modifications and variations may be made without departing from the principle of the present invention, and these modifications and variations should also be construed as falling within the protection scope of the present invention.

What is claimed is:

1. A smart remote control system, comprising: a terminal device, and a plurality of primary devices;

wherein remote control panels of the plurality of primary devices are pre-configured in the terminal device, and the terminal device is configured to:

maintain information pair (Panel ID, Address, Port) for each primary device;

provide preview and selection options of the remote control panels for a user;

display at least one remote control panel in response to a preview operation of the user;

in response to a panel selection operation of the user, display a remote control panel selected by the user, send a communication request to a target primary device according to the information pair (Panel ID, Address, Port) relating to the remote control panel selected by the user, and establish a communication link with the target primary device after receiving a response message from the target primary device; and send control information to the target primary device in response to a user operation on the displayed remote control panel of the target primary device, to enable the target primary device to perform a control operation based on the received control information.

2. The smart remote control system according to claim 1, wherein the terminal device is further configured to:

indicate the remote control panel selected by the user is unavailable by displaying the remote control panel in a different way, when the communication link between the terminal device and the target primary device is not established successfully.

3. The smart remote control system according to claim 1, wherein the terminal device is further configured to:

send a remote control panel request message comprising identification information of a new-added primary device to a server;

receive a response message corresponding to the remote control panel request message from the server, wherein the response message comprises remote control panel information of the new-added primary device;

install the remote control panel based on the remote control panel information; and generate new information pair (Panel ID, Address, Port) for the new-added primary device.

4. The smart remote control system according to claim 1, wherein the terminal device is further configured to: update the remote control panels of the plurality of primary devices.

5. The smart remote control system according to claim 1, wherein the remote control panels of the plurality of primary devices are bitmaps.

6. The smart remote control system according to claim 1, wherein the terminal device is further configured to: collect, in response to a user operation on the displayed remote control panel, area information of the panel, and sends button information to the target primary device according to a corresponding relationship between the area information and the remote control panel.

7. A terminal device, comprising a display screen, a communication interface, a processor and a memory, wherein the memory having processor-executable instructions stored thereon, and the memory is further configured to store remote control panel data of a plurality of primary devices and information pair (Panel ID, Address, Port) for each primary device; wherein the processor is configured to execute the instructions stored in the memory to:

provide preview and selection options of the remote control panels for a user;

display, on the display screen, at least one remote control panel in response to a preview operation of the user;

in response to a panel selection operation of the user, display a remote control panel selected by the user on the display screen, send, by using the communication interface, a communication request to a target primary device according to the information pair (Panel ID, Address, Port) relating to the remote control panel selected by the user, and establish a communication link with the target primary device after receiving a response message from the target primary device; and send, in response to a user operation on the remote control panel of the target primary device, control information to the target primary device using the communication interface, to enable the target primary device to perform a control operation based on the received control information.

8. The terminal device according to claim 7, wherein the processor is further configured to execute the instructions stored in the memory so as to:

indicate the remote control panel selected by the user is unavailable by displaying the remote control panel in a different way, when the communication link between the terminal device and the target primary device is not established successfully.

9. The terminal device according to claim 7, wherein the processor is further configured to execute the instructions stored in the memory so as to:

send a remote control panel request message comprising identification information of a new-added primary device to a server;

receive a response message corresponding to the remote control panel request message from the server, wherein the response message comprises remote control panel information of the new-added primary device;

install the remote control panel based on the remote control panel information; and generate new information pair (Panel ID, Address, Port) for the new-added primary device.

10. The terminal device according to claim 7, wherein the processor is further configured to execute the instructions stored in the memory so as to: update the remote control panels of the plurality of primary devices.

11. The terminal device according to claim 7, wherein the remote control panels of the plurality of primary devices are bitmaps.

12. A method for a terminal device remote controlling a plurality of primary devices, wherein remote control panels of the plurality of primary devices are pre-configured in the terminal device, and information pair (Panel ID, Address, Port) for each primary device is stored in terminal device; wherein the method comprises:

providing preview and selection options of the remote control panels for a user;

displaying at least one remote control panel in response to a preview operation of the user;

in response to a panel selection operation of the user, displaying a remote control panel selected by the user, sending a communication request to a target primary device according to the information pair (Panel ID, Address, Port) relating to the remote control panel selected by the user, and establishing a communication link with the target primary device after receiving a response message from the target primary device; and sending control information to the target primary device in response to a user operation on the displayed remote control panel of the target primary device, to enable the target primary device to perform a control operation corresponding to the control information.

13. The method according to claim 12, wherein further comprising:

indicating the remote control panel selected by the user is unavailable by displaying the remote control panel in a different way, when the communication link between the terminal device and the target primary device is not established successfully.

14. The method according to claim 12, wherein further comprising:

sending a remote control panel request message comprising identification information of a new-added primary device to a server;

receiving a response message corresponding to the remote control panel request message from the server, wherein the response message comprises remote control panel information of the new-added primary device;

installing the remote control panel based on the remote control panel information; and generating new information pair (Panel ID, Address, Port) for the new-added primary device.

15. The method according to claim 12, wherein further comprising: updating the remote control panels of the plurality of primary devices.

16. The method according to claim 12, wherein the remote control panels of the plurality of primary devices are bitmaps.

17. The method according to claim 12, wherein further comprising:

collecting, in response to a user operation on the displayed remote control panel, area information of the panel; and sending button information to the target primary device according to a corresponding relationship between the area information and the remote control panel.

* * * * *